US006959652B2

(12) United States Patent
Kühl et al.

(10) Patent No.: US 6,959,652 B2
(45) Date of Patent: Nov. 1, 2005

(54) TABLE OR WORKBENCH COVERING

(75) Inventors: Hans-Michael Kühl, Hirschberg (DE); Gerhard Graab, Mannheim (DE)

(73) Assignee: Carl Freudenberg KG, Weinheim (DE)

( * ) Notice: Subject to any disclaimer, the term of this patent is extended or adjusted under 35 U.S.C. 154(b) by 360 days.

(21) Appl. No.: 10/272,043

(22) Filed: Oct. 15, 2002

(65) Prior Publication Data

US 2003/0095394 A1 May 22, 2003

(30) Foreign Application Priority Data

Nov. 17, 2001 (DE) ..... 101 56 635

(51) Int. Cl.[7] ..... A47B 13/08
(52) U.S. Cl. ..... 108/90; 108/161
(58) Field of Search ..... 108/90, 161; 150/158, 150/154, 165, 961

(56) References Cited

U.S. PATENT DOCUMENTS 4,670,075 A 6/1987 Heckel et al.
5,759,649 A 6/1998 Dinter et al.
6,014,935 A * 1/2000 Willett ..... 108/90
6,113,199 A * 9/2000 Foote ..... 108/90

FOREIGN PATENT DOCUMENTS

| | | |
|---|---|---|
| DE | 2824739 | 2/1979 |
| DE | 3237633 | 4/1984 |
| DE | 3440572 | 5/1986 |
| DE | 69025889 | 9/1996 |
| DE | 19726728 | 1/1999 |
| HU | P9502534 | 3/1996 |
| JP | 02283443 | 2/1987 |
| JP | 62043463 | 11/1990 |

* cited by examiner

*Primary Examiner*—José V. Chen
(74) *Attorney, Agent, or Firm*—Kenyon & Kenyon

(57) ABSTRACT

A table- or workbench covering made of a first electrically conductive layer having a specific resistance in the range of $5\times10^6$ Ωcm to $5\times10^9$ Ωcm, and a second electrically conductive layer having a specific resistance in the range of $5\times10^4$ Ωcm to $5\times10^7$ Ωcm, the layers being made of rubber mixtures containing antistatic agents and/or electrically conductive particles and are calendered together as well as connected by vulcanization, and which have a sulfate content of <100 $\mu g/cm^2$, extractable using deionized water.

20 Claims, No Drawings

TABLE OR WORKBENCH COVERING

BACKGROUND OF THE INVENTION

1. Field of the Invention

The invention relates generally to a table or workbench covering which is electrically conductive. In particular, the invention is a cover made of a first electrically conductive layer having a specific resistance in the range of $5\times10^6$ Ωcm to $5\times10^9$ Ωcm, and a second electrically conductive layer having a specific resistance of $5\times10^4$ to $5\times10^7$ Ωcm, which are each made of rubber mixtures, and which contain antistatic agents and/or electrically conductive particles, as well as being connected by calendering and vulcanization.

2. Description of Related Art

Table coverings used in the electronics industry have two essential functions. On the one hand, because of their specific resistance they are in a position to make harmless electrostatic charges of tools, by their electrical discharging capability, and on the other hand their surface is intended to avoid mechanical damage to parts being worked on on the surface. Two-layer table coverings having a typical leakage resistance $R_G$ of $10^4\times10^7\Omega$ are known from the brochure of the Firm Warmbier. In view of the increasing demands on the storage density of hard disks, increasingly great requirements are being set with respect to production free from contamination. This is particularly so with regard to ionic contamination, which, in conjunction with moisture, may cause corrosion on the hard disks. Sulfate-ions have proven troublesome, among others. Up to the present, rubber table coverings have demonstrated sulfate values of an order of magnitude of 200–800 $\mu g/cm^2$ of covering surface, which is determined by extraction using deionized water and ion chromatography.

SUMMARY OF THE INVENTION

It is an object of the invention to provide an electrically conductive table or workbench covering whose volume resistance, as measured according to Standard IEC 61340-4-1, is approximately $10^7\Omega$, and whose surface resistance is approximately $5\times10^7\Omega$, and whose extractable sulfate content is reduced to an uncritical range.

These and other objects of the invention are achieved by a table or workbench covering made of a first electrically conductive layer having a specific resistance in the range of $5\times10^6$ Ωcm to $5\times10^9$ Ωcm, and a second electrically conductive layer having a specific resistance in the range of $5\times10^4$ Ωcm to $5\times10^7$ Ωcm, the layers each being made of one rubber mixture, and containing antistatic agents and/or electrically conductive particles which are calendered together as well as bonded by vulcanizing, and have a sulfate content extractable using ionized water of <100 $\mu g/cm^2$. Such table and workbench coverings permit the manufacturing of computer hard disks having a very high storage density, since the corrosion effect of extractable sulfates depends on the quantity of extractable sulfates, and this is reduced by at least 50% compared to known table and workbench coverings.

DETAILED DESCRIPTION OF THE INVENTION

Preferably, the first layer of the table and workbench covering is bright colored and contains 5–12% by weight antistatic agents for producing the electrical conductivity. As antistatic agents, compounds such as glycol esters and/or quaternary ammonium compounds are used.

The second layer of the table workbench coverings according to the invention preferably contains 5–10% by weight of electrically conductive particles and/or fibers for producing the electrical conductivity.

The table or workbench coverings according to the invention are made of rubber mixtures, selected from the classes styrene-butadiene rubber (SBR) and/or acrylonitrile-butadiene rubber (NBR), and contain 0 to 50% by weight of mineral fillers, 0 to 10% by weight of pigments and 0.2 to 10% by weight of a peroxidic curing agent.

To facilitate processing, preferably processing aids such as stearic acid and zinc stearate are added.

Especially preferred are table or workbench coverings whose layers contain 2 to 7% by weight of organic peroxides as curing agents.

The invention also provides a method for producing table or workbench coverings in which a) a first rubber mixture is made by adding 0 to 50% by weight of mineral fillers, 0 to 10% by weight of pigments, 5 to 12% by weight of antistatic agents and 0.2 to 10% by weight of a peroxidic curing agent,
b) a second rubber mixture is made by adding 0 to 50% by weight of mineral fillers, 5 to 10% by weight of electrically conductive particles and 0.2 to 10% by weight of a peroxidic curing agent,
c) layers having a thickness of 0.2 to 5 mm are calendered from the rubber mixtures and
d) in which the layers are compressed and vulcanized in a press process at a specific pressure of 2 to 50 bar, and a temperature of 120° to 250° C.

Advantageously continuous layers are produced, and these are continuously calendered together and vulcanized.

Advantageously, the table or workbench coverings according to the present invention are used in the field of manufacturing electronic devices, especially in the field of manufacturing computer hard disks.

The invention is explained more precisely below in light of the following exemplary embodiment, which should be regarded in an illustrative rather than a restrictive sense.

EXAMPLE

The table- or workbench-covering according to the present invention is made of a brightly colored first layer having a limited electrical conductivity, and a black, second layer having good electrical conductivity and which are connected in one piece manner. The first layer is made of a rubber mixture having a polymer base of the class acrylonitrile-butadiene rubber (NBR) into which are mixed mineral fillers of the class silicate, antistatic agents for producing the electrical conductivity, pigments for producing color and organic peroxides as curing agents. The second layers is made of the same polymers and the same loading materials as the first layer, the difference being that, instead of pigments, carbon black is added as an electrically conducting filler. Both mixtures are respectively mixed in a closed mixer and the raw mixtures so obtained are calendered to a final thickness of ca 1.2 mm each. The sheets of the first and the second layer are laid one over the other and vulcanized in a continuous vulcanizing machine at 100° to 190° C. under a specific pressure of 5 to 30 bar and connected together in one piece manner. Analysis of the sulfate concentrations extractable from the finely cut material using deionized water yielded 65 $\mu g/cm^2$ of the table or workbench covering according to the present invention. The composition of the individual layers is given in Table 1.

TABLE 1

| | Brightly Colored First layer Specification in weight % | Black, Second Layer Specification in weight % |
|---|---|---|
| Acrylonitrile-butadiene rubber having acrylonitrile content of 33% | 35 | 35 |
| Silicates as brightly colored fillers | 38–43 | 38 |
| Pigments according to coloring | 5–10 | — |
| Carbon black having specific surface of 950 $m^2/g$ | — | 10 |
| Antistatic agents of type glycol ester and quaterary ammonium compounds | 9 | 9 |
| Processing aids, such as stearic acid, zinc stearate | 2 | 2 |
| Peroxide, e.g. bis-(tert.-butylperoxy-isopropyl)-benzol | 6 | 6 |
| Total | 100 | 100 |

What is claimed is:

1. A table- or workbench-covering comprising: a first electrically conductive layer having a specific resistance in the range of $5\times10^6$ Ωcm to $5\times10^9$ Ωcm and a second electrically conductive layer having a specific resistance in the range of $5\times10^4$ Ωcm to $5\times10^7$ Ωcm, the layers being made of a rubber mixture containing an antistatic agent or electrically conductive particles, and being calendered together as well as connected by vulcanization, wherein the layers have a sulfate content of <100 $\mu g/cm^2$, which is extractable using deionized water.

2. The table- or workbench-covering according to claim 1, wherein the first layer is brightly colored and contains 5 to 12% by weight of antistatic agents for producing electrical conductivity.

3. The table- or workbench-covering according to claim 2, wherein the second layer contains 5 to 10% by weight of electrically conductive particles or fibers for producing electrical conductivity.

4. The table- or workbench-covering according to claim 3, wherein the layers contain 2 through 7% by weight of an organic peroxide as a curing agent.

5. The table- or workbench-covering according to claim 2, wherein the layers contain 2 through 7% by weight of an organic peroxide as a curing agent.

6. The table- or workbench-covering according to claim 1, wherein the second layer contains 5 to 10% by weight of electrically conductive particles or fibers for producing electrical conductivity.

7. The table- or workbench-covering according to claim 6, wherein the rubber mixture comprises polymers selected from the group consisting of styrene-butadiene rubber (SBR) and acrylonitrile-butadiene rubber (NBR), and contain 0 to 50% by weight of mineral fillers, 0 to 10% by weight of pigments and 0.2 to 10% by weight of a peroxidic curing agent.

8. The table- or workbench-covering according to claim 7, wherein the layers contain 2 through 7% by weight of an organic peroxide as a curing agent.

9. The table- or workbench-covering according to claim 6, wherein the layers contain 2 through 7% by weight of an organic peroxide as a curing agent.

10. The table- or workbench-covering according to claim 2, wherein the rubber mixture comprises polymers selected from the group consisting of styrene-butadiene rubber (SBR) and acrylonitrile-butadiene rubber (NBR), and contain 0 to 50% by weight of mineral fillers, 0 to 10% by weight of pigments and 0.2 to 10% by weight of a peroxidic curing agent.

11. The table- or workbench-covering according to claim 10, wherein the layers contain 2 through 7% by weight of an organic peroxide as a curing agent.

12. The table- or workbench-covering according to claim 1, further comprising a processing aid.

13. The table- or workbench-covering according to claim 12, wherein the layers contain 2 through 7% by weight of an organic peroxide as a curing agent.

14. The table- or workbench-covering according to claim 1, wherein the layers contain 2 through 7% by weight of an organic peroxide as a curing agent.

15. The table- or workbench-covering according to claim 1, wherein the rubber mixture comprises polymers selected from the group consisting of styrene-butadiene rubber (SBR) and acrylonitrile-butadiene rubber (NBR), and mixtures thereof, and contain 0 to 50% by weight of mineral fillers, 0 to 10% by weight of pigments and 0.2 to 10% by weight of a peroxidic curing agent.

16. The table- or workbench-covering according to claim 15, wherein the layers contain 2 through 7% by weight of an organic peroxide as a curing agent.

17. A method for producing the table- or workbench-covering according to claim 1, comprising:

a) forming a first rubber mixture by adding 0 to 50% by weight of mineral filler, 0 to 10% by weight of pigment, 5 to 12% by weight of antistatic agent and 0.2 to 10% by weight of a peroxidic curing agent, b) forming a second rubber mixture by adding 0 to 50% by weight of mineral fillers, 5 to 10% by weight of electrically conductive particles and 0.2 to 10% by weight of a peroxidic curing agent, c) calendering layers having a thickness of 0.2 to 5 mm from the rubber mixtures and d) compressing and vulcanizing the layers in a press process at a specific pressure of 2 to 50 bar, and a temperature of 120° to 250° C.

18. The method according to claim 17, wherein continuous layers are produced and are continuously vulcanized together.

19. A table- or workbench-covering for manufacturing electronic devices according to claim 1.

20. A table- or workbench-covering for manufacturing hard disks according to claim 19.

* * * * *